US007018287B2

(12) United States Patent
Kupferberg et al.

(10) Patent No.: US 7,018,287 B2
(45) Date of Patent: Mar. 28, 2006

(54) HIGH VELOCITY AND HIGH DILUTION EXHAUST SYSTEM

(76) Inventors: Minel Kupferberg, 5862, Ferncroft Road, Hampstead (Quebec) (CA) H3X 1C7; Marc Robitaille, 860 Helen Road, Gatineau (Quebec) (CA) J8M 1M8

( * ) Notice: Subject to any disclaimer, the term of this patent is extended or adjusted under 35 U.S.C. 154(b) by 0 days.

(21) Appl. No.: 10/896,369

(22) Filed: Jul. 22, 2004
(Under 37 CFR 1.47)

(65) Prior Publication Data

US 2006/0019592 A1 Jan. 26, 2006

(51) Int. Cl.
*F23L 17/02* (2006.01)

(52) U.S. Cl. ..... 454/16; 110/162; 415/212.1; 454/40

(58) Field of Classification Search ..... 454/16, 454/1, 39, 40; 110/162; 415/212.1; 417/198
See application file for complete search history.

(56) References Cited

U.S. PATENT DOCUMENTS

| | | | | | |
|---|---|---|---|---|---|
| 94,115 | A * | 8/1869 | Hynes | 454/39 |
| 126,797 | A * | 5/1872 | Freeborn | 454/35 |
| 1,770,986 | A * | 7/1930 | Liagre | 454/368 |
| 2,561,135 | A * | 7/1951 | Resek | 110/162 |
| 3,592,122 | A * | 7/1971 | Hughes | 454/16 |
| 3,841,208 | A * | 10/1974 | Knox | 454/16 |
| 5,439,349 | A | 8/1995 | Kupferberg | |
| 2003/0114098 | A1* | 6/2003 | Hill et al. | 454/16 |

* cited by examiner

*Primary Examiner*—Harold Joyce
(74) *Attorney, Agent, or Firm*—Hoffman, Wasson & Gitler

(57) ABSTRACT

The high velocity and high dilution exhaust system uses a centrifugal fan provided with a tapered nozzle. The nozzle compresses the airstream exiting the fan to increase back pressure and velocity. The air flow from the fan enters a stack having a venturi further increasing the velocity and decreasing the pressure. The decrease in pressure causes a suction, allowing the introduction of ambient air to mix with and dilute the output of the fan. The total discharge from the exhaust stack has a high velocity resulting in a plume height and effective height of the exhaust before dispersion occurs.

4 Claims, 12 Drawing Sheets

HIGH VELOCITY AND HIGH DILUTION EXHAUST SYSTEM

BACKGROUND OF THE INVENTION

Industrial and institutional processes often produce fumes required to be exhausted and removed from the immediate area of the building. Exhaust systems include ducts, hoods, and exhaust fans to extract the contaminated fumes. Specific applications, such as laboratory or processing exhaust, are hazardous and must be exhausted to insure the safety of those working in close proximity to the source of the exhausted effluent. Safety concerns extend not only to those in the immediate area where the fumes are generated, but also to others located in the building as well as occupants in surrounding buildings.

Improperly designed exhaust systems that ineffectively discharge high concentrations of effluent can result in entrainment of the hazardous or noxious exhaust into the building air conditioning system, contaminating the fresh air brought into the building.

Problems are encountered in particular where the contaminated exhaust is heavier than air, is corrosive or has a foul odor. In these instances it is necessary to displace the exhaust at a height allowing dispersement to negate the possibility of concentration of the effluent at ground level.

In applications where exhaust needs to be displaced high above ground level, exhaust fans and stacks are typically placed on roof tops. To insure the displacement at levels high above ground level, it is known to use long exhaust stacks having an exit orifice at the desired height. Often, the stacks are so long as to be unstable and require the use of guy wires or other braces to ensure their stability, especially if high wind conditions are ever expected.

There is a need in the prior art for an improvement in the design of a fan and stack to deliver fumes to a maximum possible height, before dispersion of the exhaust within the environment occurs to allow complete dissipation and prevent concentration and contamination of the buildings at lower levels.

It is an object of the invention to provide an exhaust fan having a high plume height.

It is another object of the invention to have an exhaust fan having a compact configuration.

It is yet another object of the invention to provide a exhaust fan requiring low energy but having a high exhaust velocity.

It is another object of the invention to provide an exhaust fan allowing dispersement at a height preventing exhaust from reentering a building through an air conditioning system or other roof mounted equipment.

It is still another object of the invention to allow dispersement of exhaust eliminating costly corrosion caused by exhaust vapors.

It is another objective of the invention to provide an exhaust for diluting the exhaust before exiting the exhaust stack.

These and other objects of the invention will become apparent to one of ordinary skill in the art after reviewing disclosure of the invention.

SUMMARY OF THE INVENTION

The high velocity and high dilution exhaust system uses a centrifugal fan provided with a tapered nozzle. The nozzle compresses the airstream exiting the fan to increase back pressure and velocity. The air flow from the fan enters a stack having a venturi further increasing the velocity and decreasing the pressure. The decrease in pressure causes a suction, allowing the introduction of ambient air to mix with and dilute the output of the fan. The total discharge from the exhaust stack has a high velocity resulting in a plume height and effective height of the exhaust before dispersion occurs.

DETAILED DESCRIPTION OF THE INVENTION

Figures 1A, 1B:
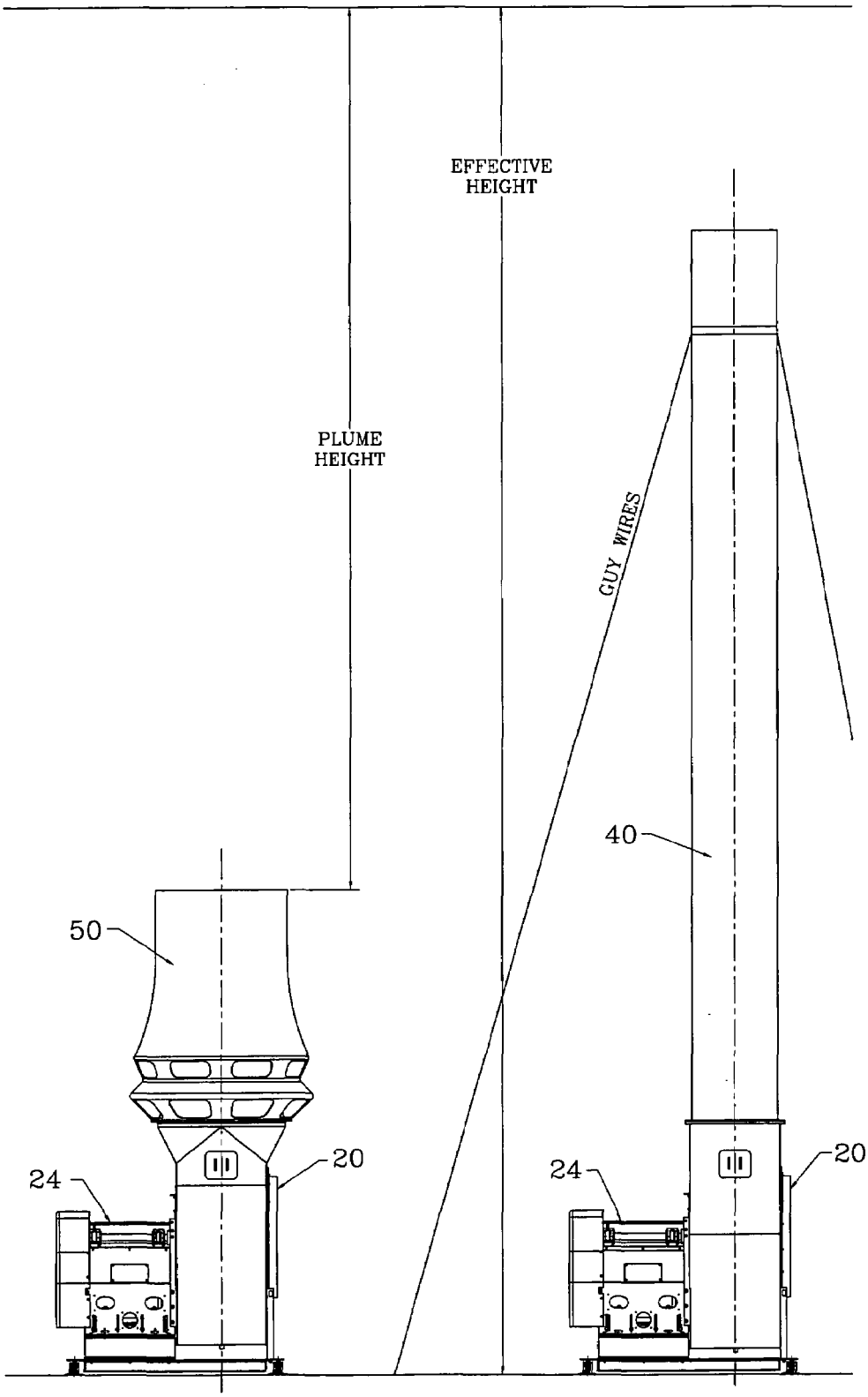
FIGURE 1a Prior Art
FIG. 1*a* is a end view of a prior art exhaust system.
FIG. 1*b* is a end view of the high velocity and high dilution exhaust system of the invention.

FIG. 1*a* shows a conventional exhaust system, as may be mounted on a roof. The centrifugal fan 20, powered by motor 24, receives exhaust from the ventilation system of the building and sends exhaust through exhaust stack 40. Upon exiting the top of the exhaust stack 40, the exhaust travels a short distance before dissipating within the ambient air. The total distance of the stack and distance traveled before dispersement is shown as the effective height.

FIG. 1*b* shows a centrifugal fan having the exhaust stack of the invention. The exhaust leaves the stack 50 with high velocity and stream integrity and has a plume height giving an effective height equal to that of prior art devices having a high stack. The invention has the advantage of diluting the effluent with a compact configuration.

Figure 2:
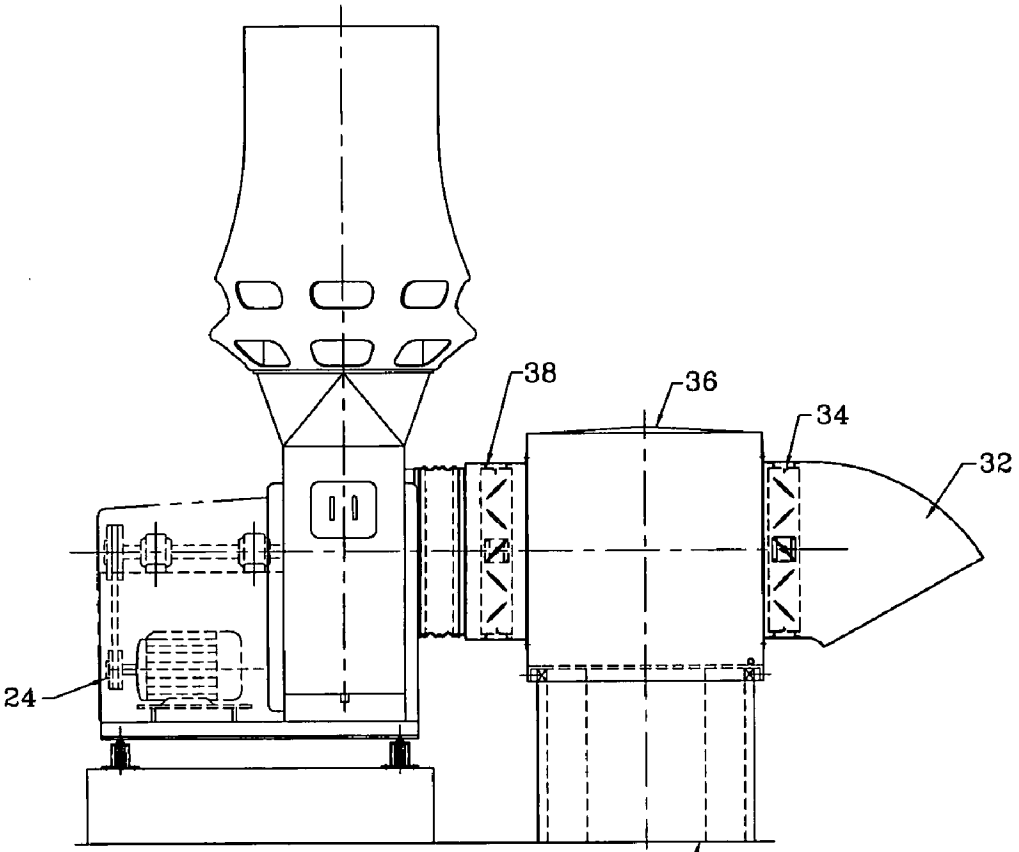
FIG. 2 is a side view of the exhaust system of the invention attached to a plenum.

FIG. 2 shows the centrifugal fan and exhaust stack as part of a ventilation system. Exhaust is received through a duct 30 terminating at the inlet plenum 36. The inlet plenum 36 is provided with an ambient by-pass 32 having by-pass damper with louver 34. Within the plenum, the exhaust from duct 30 and ambient air through by-pass 32 forms the inlet fan flow entering centrifugal fan 20 through isolation damper 38. Motor 24 powers centrifugal fan to spin the inlet fan flow and produce pulsed turbulent flow. Fan 20 is provided with a nozzle, to be described later, to stabilize the pulsed turbulent flow exiting the centrifugal fan 20.

Figure 3:
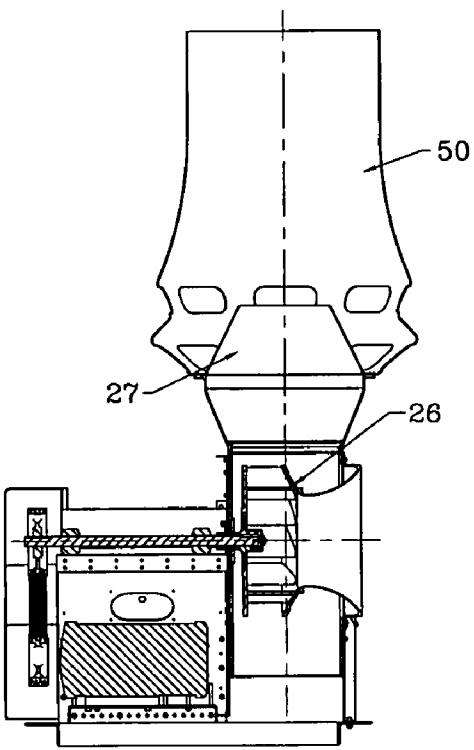
FIG. 3 is a cross-sectional view of the exhaust stack on a centrifugal fan.

FIG. 3 shows a cross-sectional side view of the stack applied to the centrifugal blower. The outlet to the blower 20 is provided with a frustroconical nozzle 27.

Figure 4:
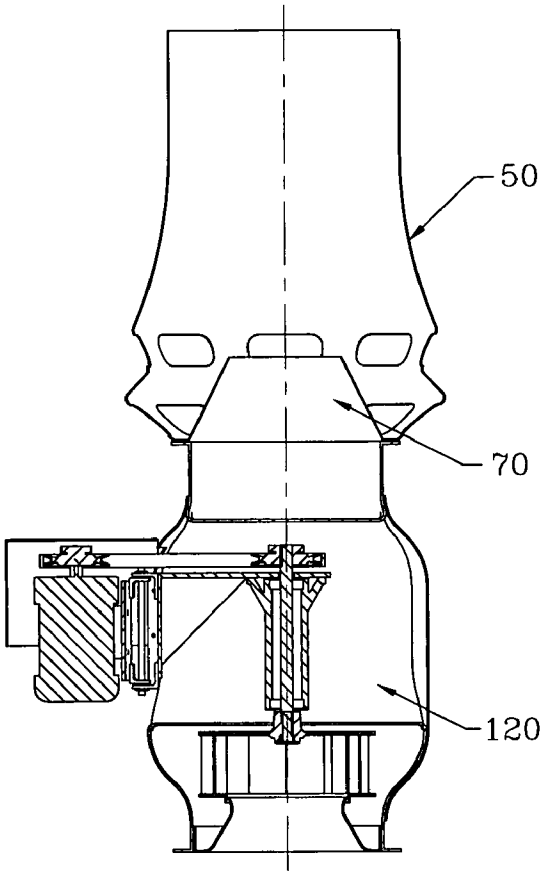
FIG. 4 is a cross-sectional view of the exhaust stack on an axial fan.

FIG. 4 shows the same stack 50 applied to an axial fan 120. Similar to the centrifugal blower, the outlet of the axial fan is provided with a frustroconical nozzle 27. The purpose of the nozzle will be explained later. While the axial fan is shown as being a belt driven fan, a direct drive axial fan could also be used.

Figure 5:
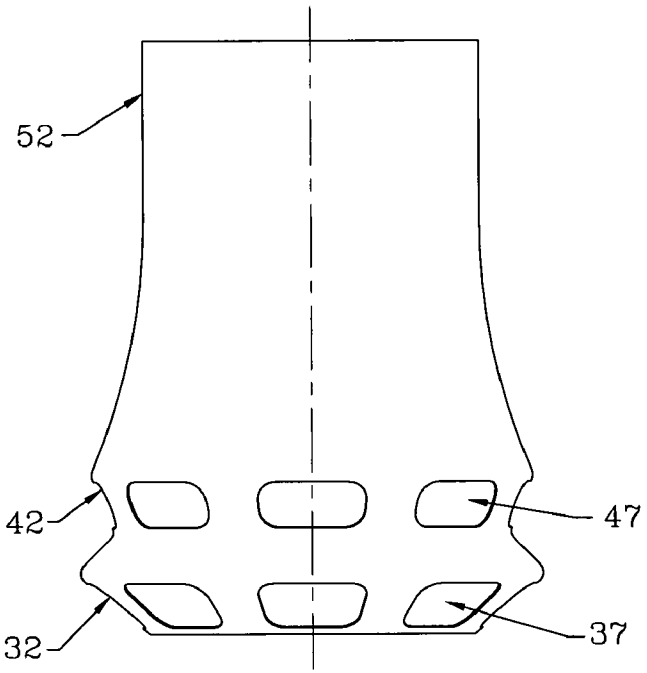
FIG. 5 is a side view of the stack.

FIG. 5 shows the exhaust tower for diluting and accelerating the fan exhaust. The nozzle cap has a cross-shaped aperture compressing and increasing the velocity of the fan exhaust. The nozzle cap stabilizes the pulse turbulent flow produced by a centrifugal fan. The shape of the nozzle cap maximizes vacuum around it by increasing the contact surface area of the exhaust plume. The cross shape also gently spins the exiting air to create a light vortex for the purpose of mixing the entrained ambient air with the fan supplied air and creating inducement.

Air exiting the nozzle enters the first stage 32. The first stage is formed by a outwardly extending flange having a bottom opening which surrounds the bottom of nozzle cap 25. An inwardly extending flange extends from the top of the outwardly extending flange to a point of minimum diameter. Ambient air within the first stage is induced by the high velocity air stream created by the nozzle. The entrainment of ambient air within the first stage causes flow of air outside the exhaust tower into the first stage 32 through the first set of apertures 37.

The mixture of the fan exhaust and air entrained in the first stage is directed over the second stage 42 creating a second entrainment. The second stage 42 has an outward taper extending from this point of minimum diameter and joins exhaust stack 52. Air from the second entrainment is provided for the second set of apertures 47.

The total entrained air from stage 1 and 2 and the fan supplied air is mixed in the exhaust stack 52 by the vortex effect created by the nozzle cap. The stack stabilizes the total air before exiting. The resulting plume exits the stack in a linear column reaching a better height compared to unstable and turbulent air that do not have the entrainment and stabilizing features of the exhaust tower.

Figure 6B:
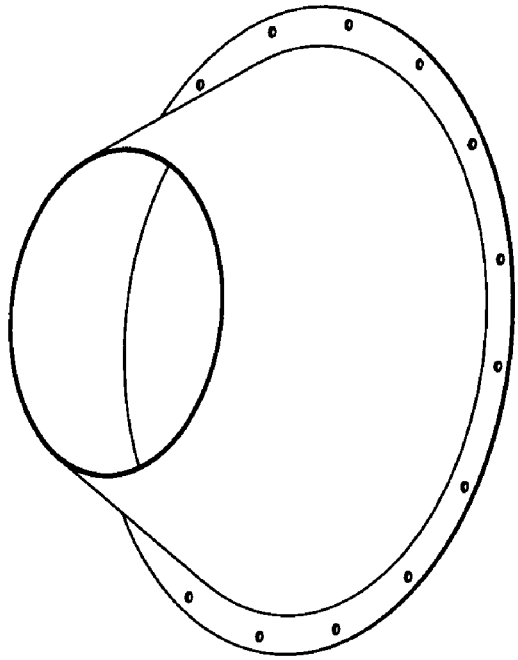
FIG. 6*b* is a perspective view of the conical nozzle.
Figure 6A:
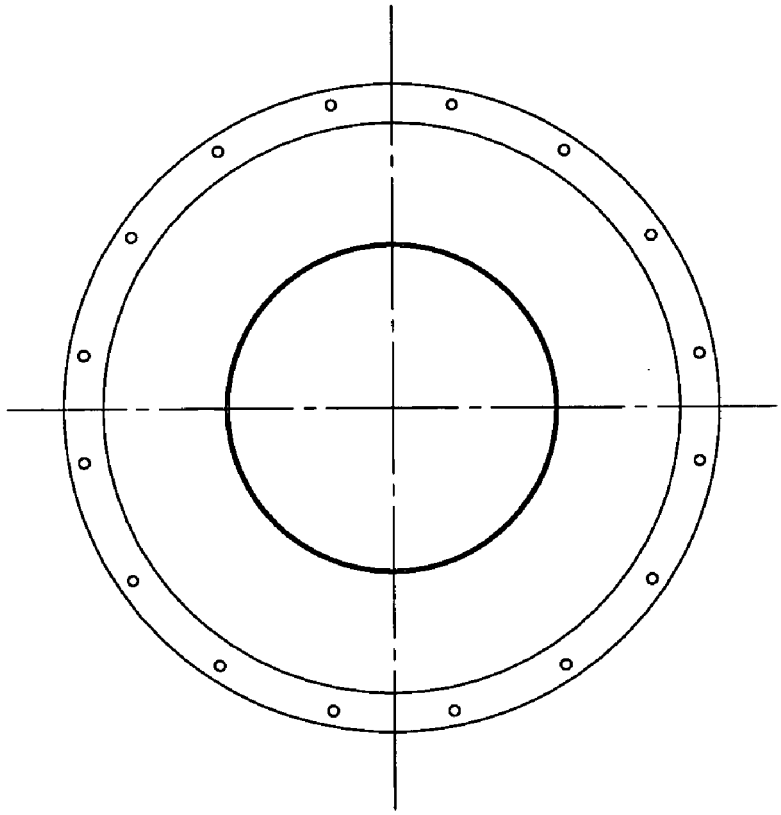
FIG. 6*a* is a top view of a conical nozzle.
Figure 7B:
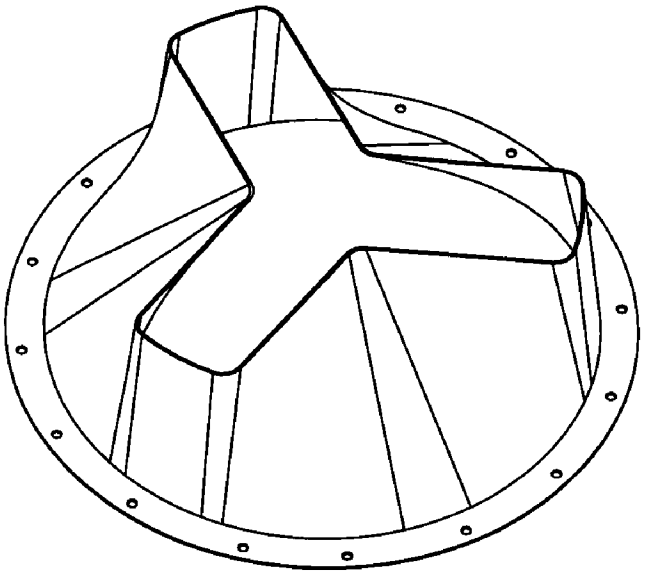
FIG. 7*b* is a perspective view of the three slot nozzle.
Figure 7A:
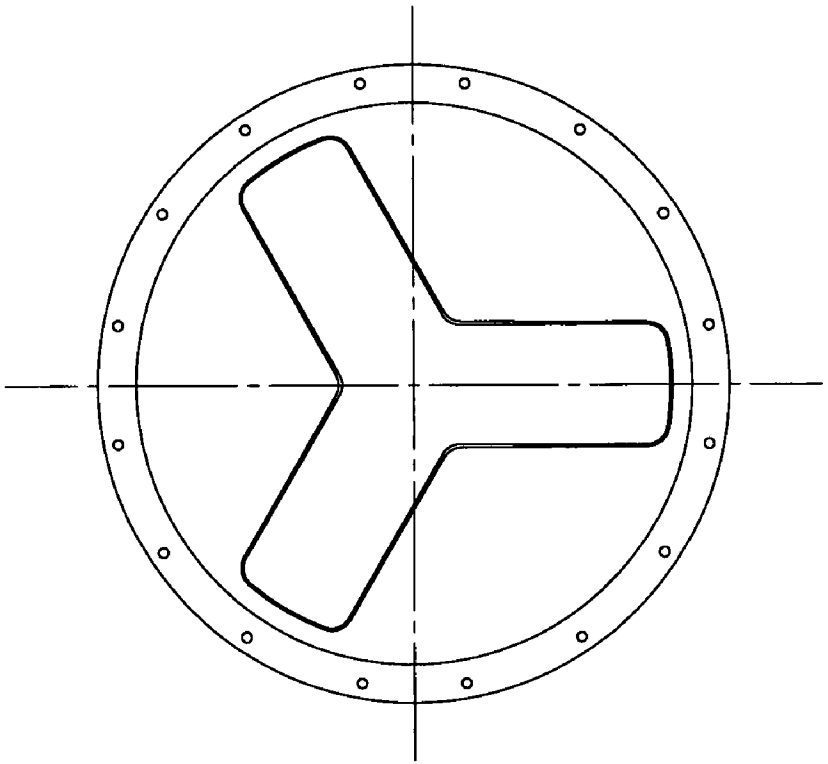
FIG. 7*a* is a top view of a three slot nozzle.
Figure 8B:
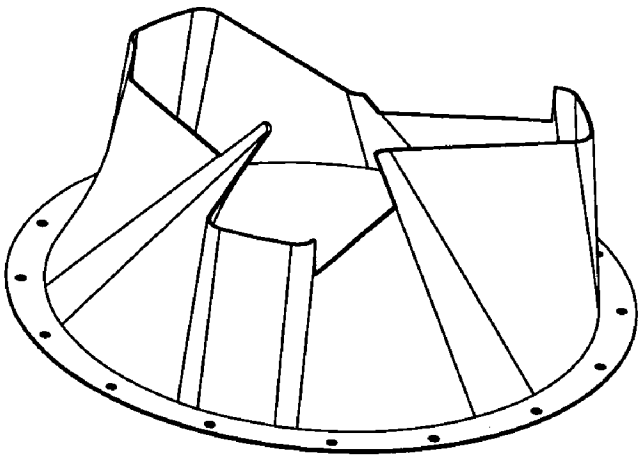
FIG. 8*b* is a perspective view of the twisted three slot nozzle.
Figure 8A:
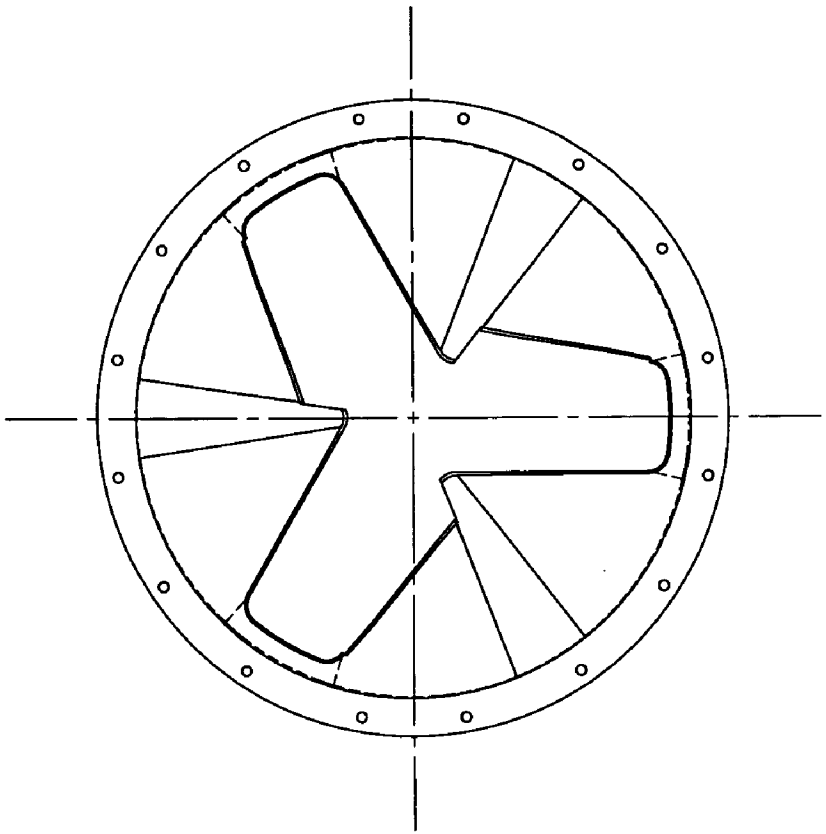
FIG. 8*a* is a top view of a twisted three slot nozzle.
Figure 9B:
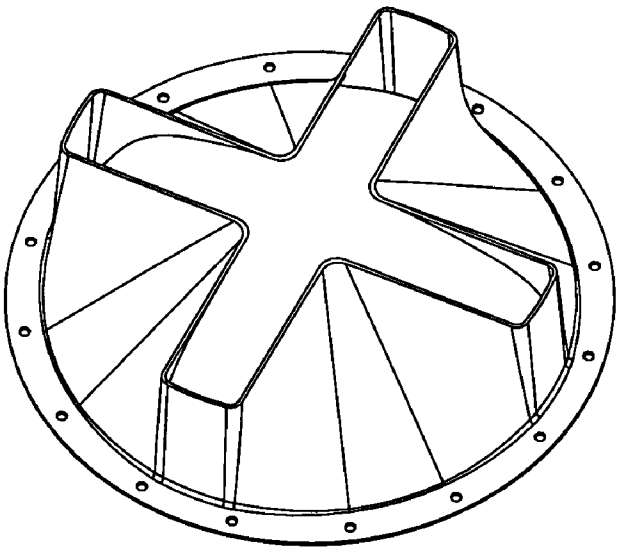
FIG. 9*b* is a perspective view of the four slot nozzle.
Figure 9A:
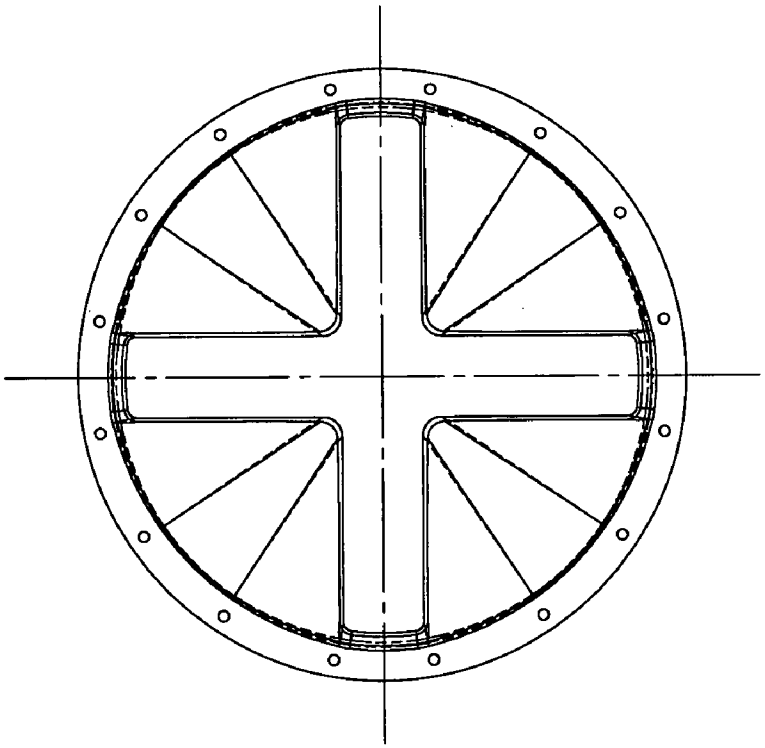
FIG. 9*a* is a top view of a four slot nozzle.
Figure 10B:
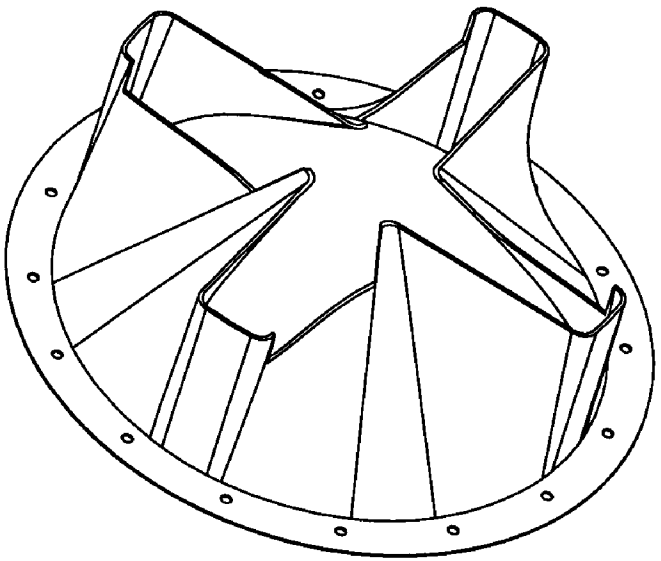
FIG. 10*b* is a perspective view of the twisted four slot nozzle.
Figure 10A:
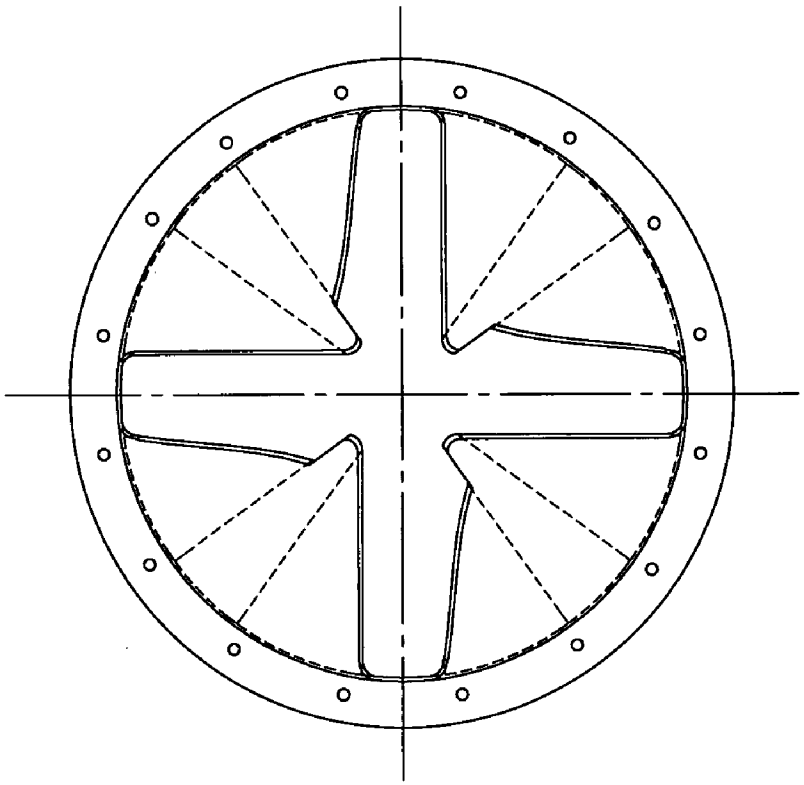
FIG. 10*a* is a top view of a twisted four slot nozzle.
Figure 11B:
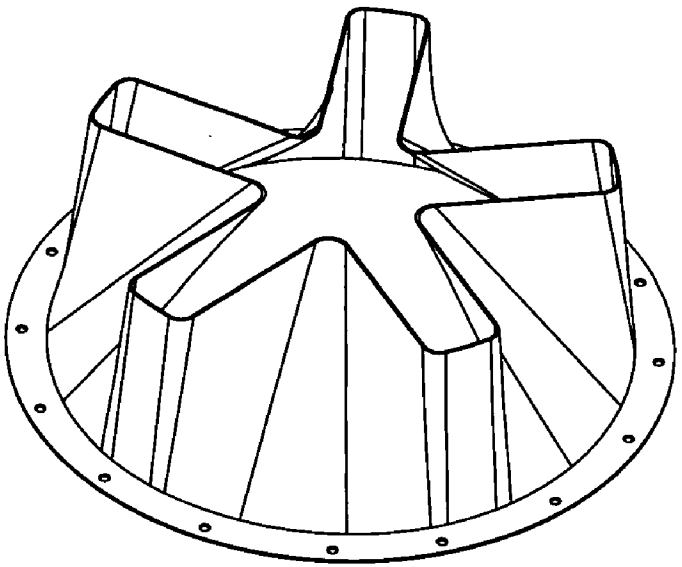
FIG. 11*b* is a perspective view of the five slot nozzle.
Figure 11A:
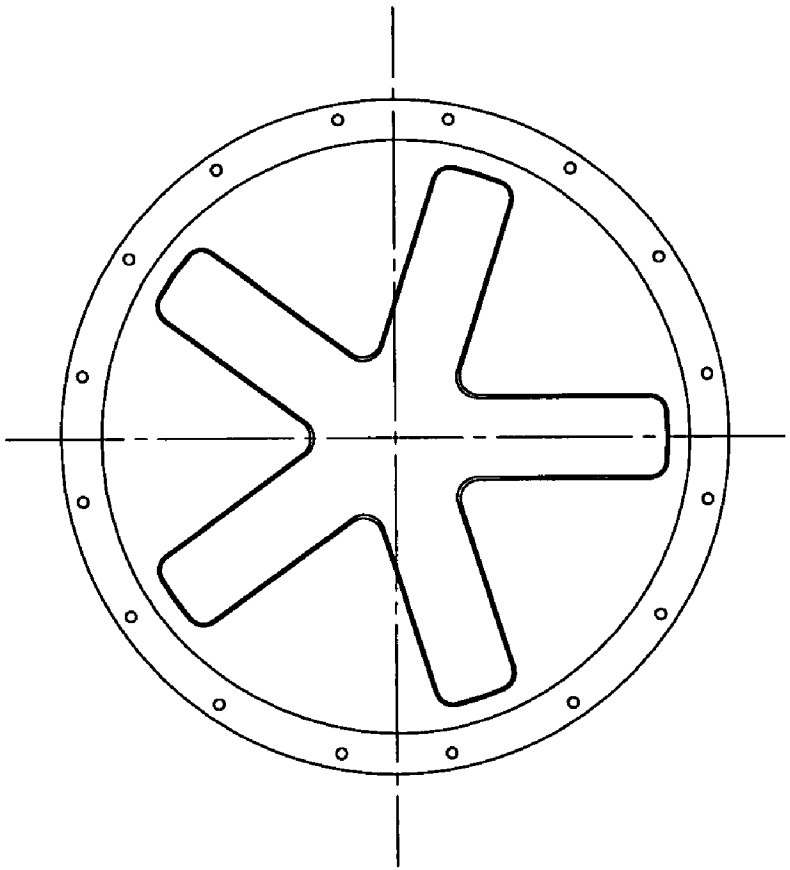
FIG. 11*a* is a top view of a five slot nozzle.
Figure 12B:
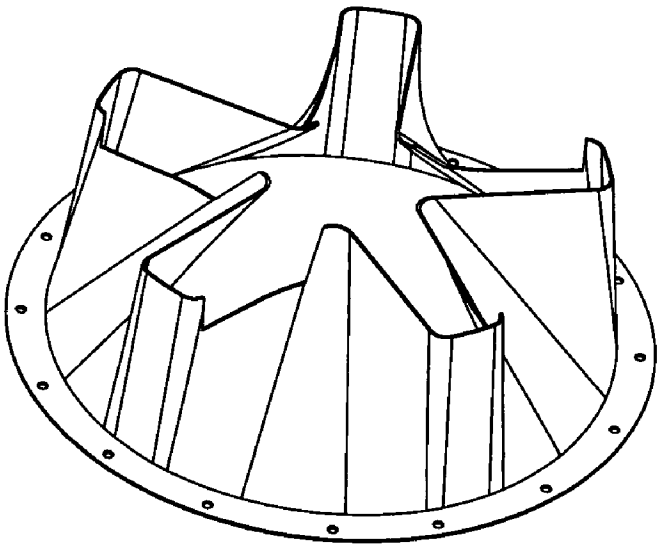
FIG. 12*b* is a perspective view of the twisted five slot nozzle.
Figure 12A:
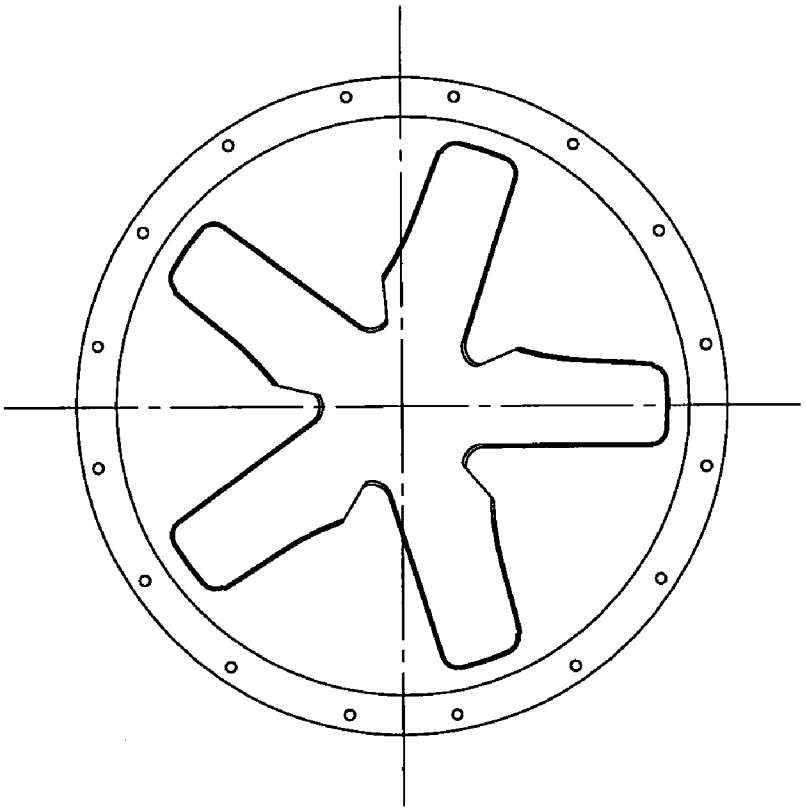
FIG. 12*a* is a top view of a twisted five slot nozzle.
Figure 13B:
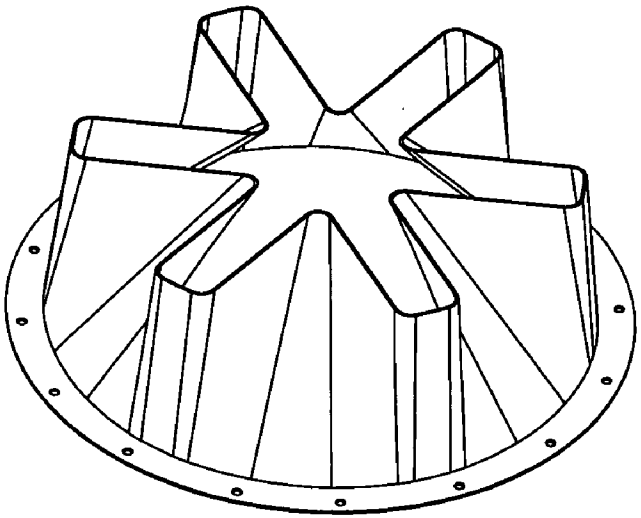
FIG. 13*b* is a perspective view of the six slot nozzle.
Figure 13A:
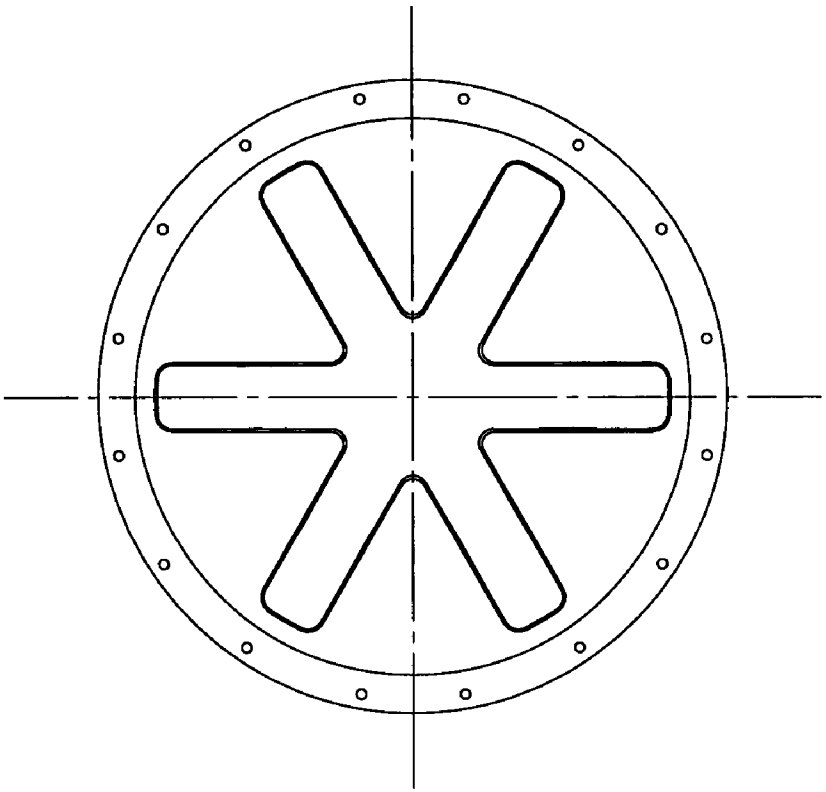
FIG. 13*a* is a top view of a six slot nozzle.
Figure 14B:
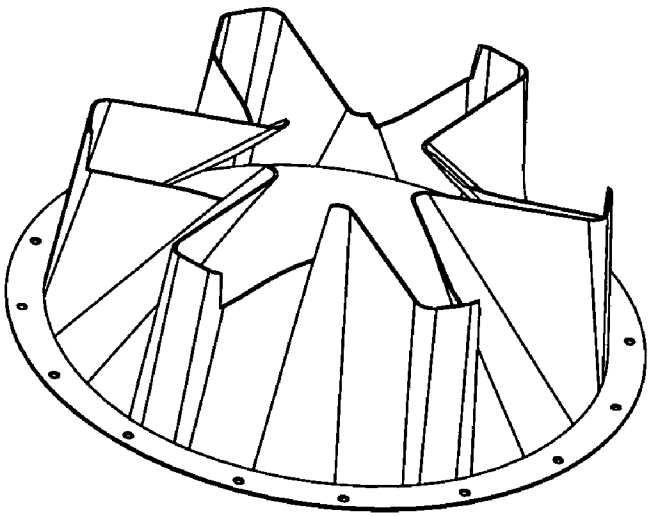
FIG. 14*b* is a perspective view of the twisted six slot nozzle.
Figure 14A:
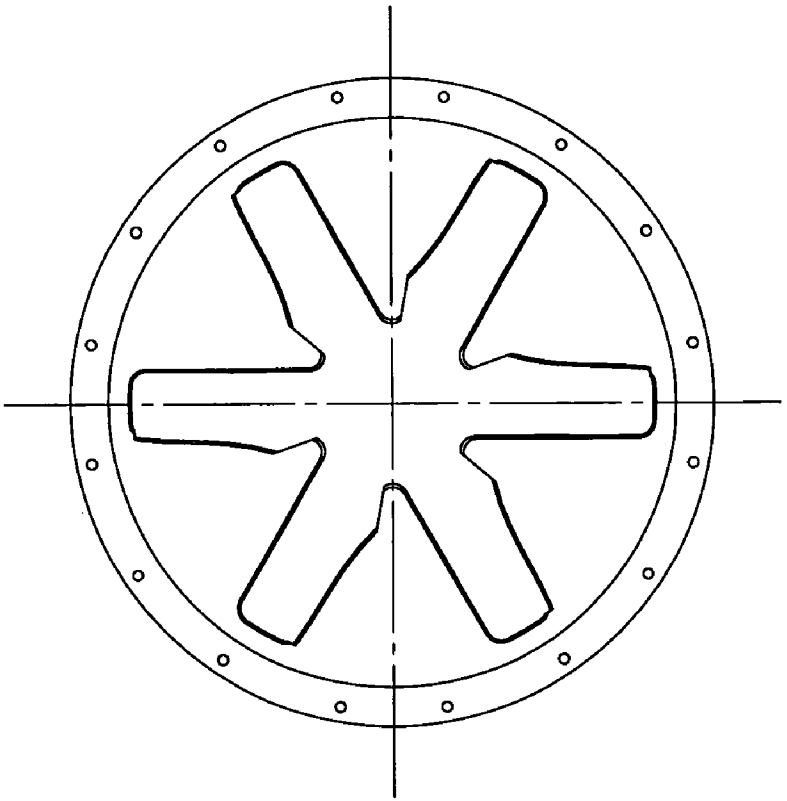
FIG. 14*a* is a top view of a twisted six slot nozzle.

FIGS. 6*a*–14*b* show various configurations of a nozzle. While FIGS. 6*a* and 6*b* show the frustroconical nozzle depicted in FIGS. 3 and 4, the remaining figures show nozzles having slots varying in numbers from three to six. Each of the embodiments of the nozzle, from three slot to six slot, also has a twisted variation shown in FIGS. 8, 10, 12 and 14. In this configuration, the slots are twisted so as to have sloped walls. The twist increases rotation of the exiting air. As is obvious, the greater number of slots increases the surface area of the resulting plume, but the number of slots must not be increased to the extent where the plume loses the integrity of its shape.

While the invention has been described with reference to a preferred embodiment, and variations and modifications would be apparent to one of ordinary skill in the art. The invention encompasses such variations and modifications.

We claim:

1. An exhaust stack, comprising a first stage having a lower end for receiving exhaust, said first stage having apertures for allowing air from outside the exhaust stack to enter, and a second stage connected to an upper end of the first stage for receiving air flow from said first stage, said second stage having apertures for allowing air from outside the exhaust stack to enter said first stage has a first outwardly and upwardly extending flange, and a second inwardly and upwardly extending flange extending from said first flange, said first flange having a plurality of apertures.

2. The exhaust stack of claim 1, wherein said second stage has a third outwardly and upwardly extending flange, and a tower extending upwardly from said third flange, said third flange having a plurality of apertures.

3. A ventilation system, comprising a fan, and an exhaust stack extending from said fan, said exhaust stack comprising a first stage having a lower end receiving exhaust from said fan, said first stage having apertures for allowing air from outside the exhaust stack to enter, and a second stare connected to an upper end of the first stage for receiving air flow from said first stage, said second stage having apertures for allowing air from outside the exhaust stack to enter said first stage has a first outwardly and upwardly extending flange, and a second inwardly and upwardly extending flange extending from said first flange, said first flange having a plurality of apertures.

4. The ventilation system of claim 3, wherein said second stage has a third outwardly and upwardly extending flange, and a tower extending upwardly from said third flange, said third flange having a plurality of apertures.

* * * * *